US009953567B2

(12) United States Patent
Wang

(10) Patent No.: US 9,953,567 B2
(45) Date of Patent: Apr. 24, 2018

(54) PIXEL CIRCUIT AND ORGANIC LIGHT-EMITTING DISPLAY DEVICE INCLUDING THE SAME

(71) Applicant: Samsung Display Co., Ltd., Yongin (KR)

(72) Inventor: Insoo Wang, Yongin (KR)

(73) Assignee: Samsung Display Co., Ltd, Yongin-si (KR)

( * ) Notice: Subject to any disclaimer, the term of this patent is extended or adjusted under 35 U.S.C. 154(b) by 225 days.

(21) Appl. No.: 14/705,515

(22) Filed: May 6, 2015

(65) Prior Publication Data

US 2016/0148565 A1 May 26, 2016

(30) Foreign Application Priority Data

Nov. 21, 2014 (KR) ..... 10-2014-0163821

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/325* (2013.01); *G09G 3/3258* (2013.01);
(Continued)

(58) Field of Classification Search
CPC ..... G09G 3/3233; G09G 3/325; G09G 2320/0209; G09G 2300/0876; G09G 2300/0852; G09G 3/3258
See application file for complete search history.

(56) References Cited

U.S. PATENT DOCUMENTS

2008/0272703 A1 11/2008 Chan et al.
2010/0309187 A1 12/2010 Kang et al.
(Continued)

FOREIGN PATENT DOCUMENTS

KR 10-2008-0101582 11/2008
KR 10-2010-0131118 12/2010

*Primary Examiner* — William Boddie
*Assistant Examiner* — Saifeldin Elnafia
(74) *Attorney, Agent, or Firm* — H.C. Park & Associates, PLC

(57) ABSTRACT

Provided is an organic light-emitting display device including: a first pixel; a second pixel; and a common capacitor connected to the first and second pixels, wherein the first pixel comprises: a first switching transistor transmitting a first data signal in response to a first scan signal; a second switching transistor transmitting the first data signal to the common capacitor; a first storage capacitor storing a charge corresponding to the first data signal; a first driving transistor generating a driving current corresponding to the charge stored in the first storage capacitor; and a first organic light-emitting diode (OLED) emitting light corresponding to the first driving current, and wherein the second pixel comprises: a third switching transistor transmitting a second data signal in response to a second scan signal; a fourth switching transistor transmitting the second data signal to the common capacitor; a second storage capacitor storing a charge corresponding to the second data signal; a second driving transistor generating a driving current corresponding to the charge stored in the second storage capacitor; and a second organic light-emitting diode (OLED) emitting light corresponding to the second driving current.

11 Claims, 3 Drawing Sheets

(51) Int. Cl.
*G09G 3/325* (2016.01)
*G09G 3/3258* (2016.01)

(52) U.S. Cl.
CPC ..... *G09G 2300/0852* (2013.01); *G09G 2300/0876* (2013.01); *G09G 2320/0209* (2013.01)

(56) References Cited

U.S. PATENT DOCUMENTS

| | | | | |
|---|---|---|---|---|
| 2014/0085168 | A1 | 3/2014 | Nathan et al. | |
| 2014/0132174 | A1 | 5/2014 | Smith | |
| 2014/0176402 | A1* | 6/2014 | Lee ..... | G09G 3/32 345/77 |

* cited by examiner

PIXEL CIRCUIT AND ORGANIC LIGHT-EMITTING DISPLAY DEVICE INCLUDING THE SAME

CROSS-REFERENCE TO RELATED APPLICATION

This application claims priority from and the benefit of Korean Patent Application No. 10-2014-0163821, filed on Nov. 21, 2014, which is hereby incorporated by reference for all purposes as if fully set forth herein.

BACKGROUND

Field

Exemplary embodiments relate to a pixel circuit and an organic light-emitting display device including the same.

Discussion

Resolution and pixel density of an organic light-emitting display device can be increased to display high-quality images. Decreasing the size of elements which form pixels, for example, the size of capacitors, could increase pixel density. However, when the size of elements is decreased, display of a high-quality image may become difficult because of interference between signals.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a pixel circuit and an organic light-emitting display device capable of displaying a high-quality image.

Additional aspects will be set forth in the detailed description which follows, and, in part, will be apparent from the disclosure, or may be learned by practice of the inventive concept.

According to one or more exemplary embodiments, an organic light-emitting display device includes: a first pixel; a second pixel; and a common capacitor connected to the first and second pixels, wherein the first pixel comprises: a first switching transistor transmitting a first data signal in response to a first scan signal; a second switching transistor transmitting the first data signal to the common capacitor; a first storage capacitor storing a charge corresponding the first data signal; a first driving transistor generating a driving current corresponding to the charge stored in the first storage capacitor; and a first organic light-emitting diode (OLED) emitting light corresponding to the first driving current, and wherein the second pixel comprises: a third switching transistor transmitting a second data signal in response to a second scan signal; a fourth switching transistor transmitting the second data signal to the common capacitor; a second storage capacitor storing a charge corresponding to the second data signal; a second driving transistor generating a driving current corresponding to the charge stored in the second storage capacitor; and a second organic light-emitting diode (OLED) emitting light corresponding to the second driving current.

According to one or more exemplary embodiments, a pixel circuit included in an organic light-emitting display device, which includes common capacitors respectively having first electrodes and second electrodes and arranged in respective columns of the organic light-emitting device, the pixel circuit includes: a first switching transistor transmitting a data signal in response to a scan signal; a second switching transistor transmitting the data signal, to the first electrode of the common capacitor; a storage capacitor storing a charge corresponding to the data signal; a driving transistor generating a driving current corresponding to the charge; and an organic light-emitting diode (OLED) emitting light according to the driving current.

According to one or more exemplary embodiments, a pixel circuit includes: a first switching transistor transmitting a data signal in response to a scan signal; a capacitor unit storing a charge corresponding to the data signal; a driving transistor generating a driving current corresponding to the charge; an organic light-emitting diode (OLED) emitting light corresponding to the driving current; and a control circuit unit to a first capacitance during a first time period when the first switching transistor is turned on and to a second capacitance during a second time period when the first switching transistor is turned off, wherein the second capacitance is smaller than the first capacitance.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
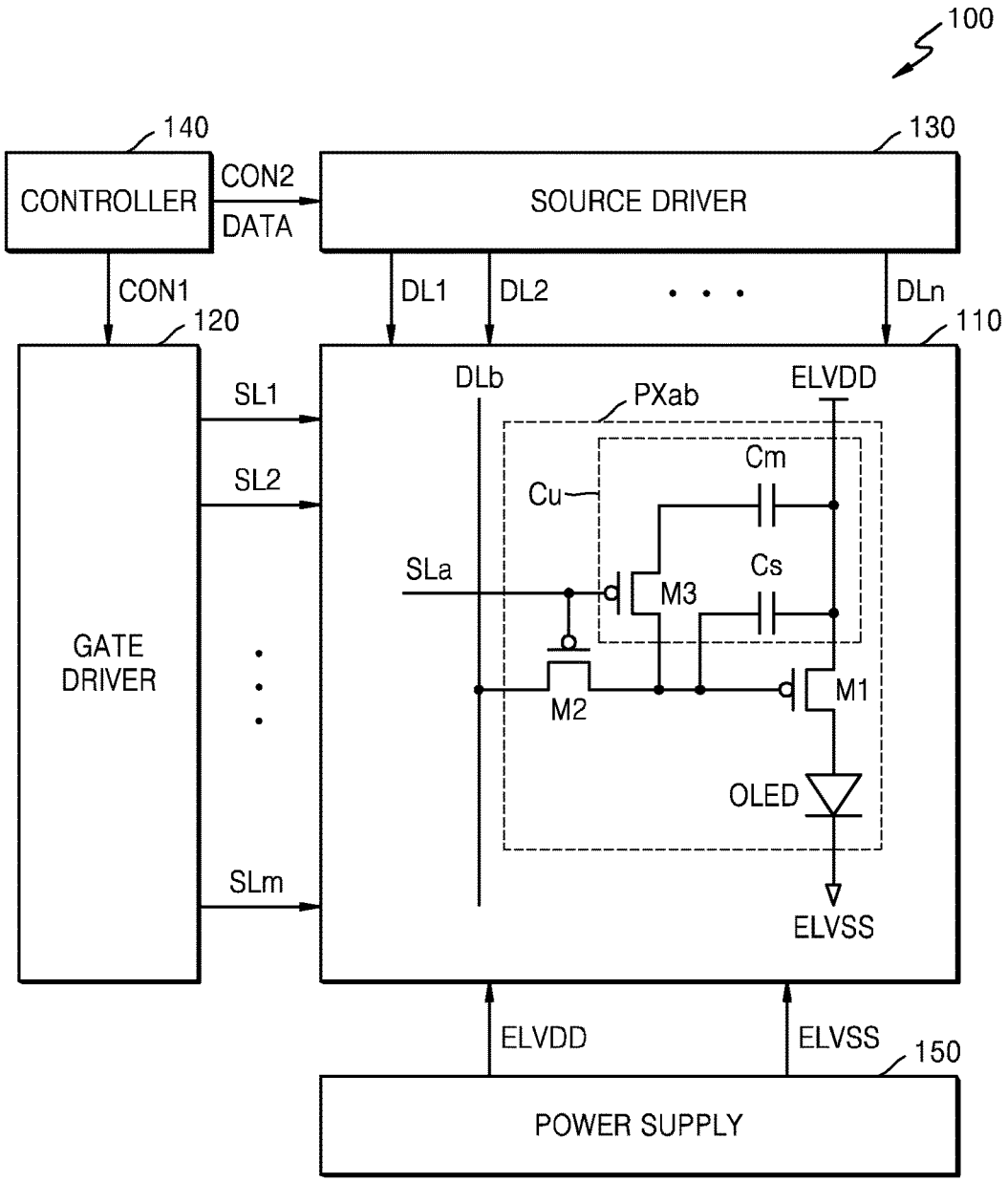
FIG. 1 is a schematic block diagram of an organic light-emitting display device according to one or more exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of components, etc., may be exaggerated for clarity and descriptive purposes. Also, like reference numerals denote like elements.

When a component is referred to as being "on," "connected to," or "coupled to" another component, it may be directly on, connected to, or coupled to the other component or intervening components may be present. When, however, a component is referred to as being "directly on," "directly connected to," or "directly coupled to" another component, there are no intervening components present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various features, these features should not be limited by these terms. These terms are used to distinguish one feature from another. Thus, a first feature could be termed a second feature without departing from the teachings of the present disclosure.

Spatially relative terms, such as "beneath," "below," "lower," "above," "upper," and the like, may be used herein for descriptive purposes, and, thereby, to describe one feature's relationship to another feature as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a schematic block diagram of an organic light-emitting display device 100 according to one or more exemplary embodiments.

Referring to FIG. 1, organic light-emitting display device 100 includes display panel 110, gate driver 120, source driver 130, controller 140, and power supply 150.

Organic light-emitting display device 100 may include an electronic device capable of displaying an image, for example, a smart phone, a tablet computer, a laptop, a monitor, a television (TV), a device worn on the wrist, etc., and components used to display an image of the electronic device. According to an exemplary embodiment, organic light-emitting display device 100 may be a head mounted display device. For a head mounted display device, a gap between eyes of a user and a display screen is relatively narrow, and an optical system is inserted into the gap, which may enable a user to watch the display screen enlarged by the optical system. Since the display screen is enlarged by the optical system, the pixel density perceived by the user may be significantly smaller than the actual pixel density of the display screen. Therefore, to display an image with high quality, the actual pixel density could benefit from being increased.

The display panel 110 may include a plurality of scan lines SL1 to SLm, a plurality of data lines DL1 to DLn, and pixels (hereinafter, commonly referred to as pixels PXs) connected to the scan lines SL1 to SLm and the data lines DL1 to DLn. For example, the pixels PXs include a pixel PXab connected to the scan line SLa and the data line DLb. In FIG. 1, although only the pixel PXab is illustrated in display panel 110, it should be understood that pixels PX other than pixel PXab are also included therein.

Each pixel PX included in display panel 110 may have the same circuit diagram as the pixel PXab shown in FIG. 1. According to one or more exemplary embodiments, capacitor Cm of the circuit diagram for pixel PXab shown in FIG. 1 may be implemented using a common capacitor existing in a column with the other elements of pixel PXab connected thereto, as illustrated with reference to FIGS. 2 and 3.

Controller 140 may receive external image data signals and may control gate driver 120, source driver 130, and power supply 150. Controller 140 may generate first and second control signals CON1 and CON2 and digital image data DATA. Controller 140 may provide first control signal CON1 to gate driver 120 and may provide second control signal CON2 and digital image data DATA to source driver 130. Controller 140 may also provide a third control signal (not shown) to power supply 150.

Gate driver 120 may sequentially drive scan lines SL1 to SLm in response to first control signal CON1. For example, first control signal CON1 may be a signal which orders gate driver 120 to start scanning scan lines SL1 to SLm. Gate driver 120 generates scan signals and may sequentially transmit the generated scan signals to pixels PXs through scan lines SL1 to SLm. As shown in FIG. 1, scan lines SL1 to SLm may extend in a row direction. The row direction may be a direction in which scan lines SL1 to SLm extend regardless of a direction in which organic light-emitting display device 100 is placed.

Source driver 130 may drive data lines DL1 to DLn in response to second control signal CON2 and digital image data DATA. Source driver 130 converts digital image data DATA having gradation into data signals having a corresponding voltage gradation, and may sequentially transmit converted data signals to pixels PXs through data lines DL1 to DLn. As shown in FIG. 1, data lines DL1 to DLn may extend in a column direction. The column direction may be a direction in which data lines DL1 to DLn extend regardless of a direction in which organic light-emitting display device 100 is placed or an internal arrangement thereof.

Gate driver 120, source driver 130, and controller 140 may be respectively formed in semiconductor chips or integrated in a single semiconductor chip. Gate driver 120 and display panel 110 may be formed on the same substrate.

Power supply 150 may generate first driving power ELVDD and second driving power ELVSS under the control of controller 140 and may provide the generated first driving power ELVDD and second driving power ELVSS to display panel 110. Controller 140 may control voltage levels of first driving power ELVDD and second driving power ELVSS. The voltage level of first driving power ELVDD is higher than the voltage level of second driving power ELVSS, and pixels PXs are connected between first driving power ELVDD and second driving power ELVSS and may be driven by first driving power ELVDD and second driving power ELVSS.

As shown in FIG. 1, the circuit for pixel PXab includes first switching transistor M2, capacitor unit Cu, and driving transistor M1.

First switching transistor M2 is connected to scan line SLa and data line DLb. First switching transistor M2 transmits, to capacitor unit Cu and driving transistor M1, data signals which are transmitted through data line DLb in response to scan signals transmitted through scan line SLa.

Capacitor unit Cu stores a voltage corresponding to the data signals transmitted by first switching transistor M2. Capacitor unit Cu may be connected between a gate and a source of driving transistor M1. Capacitor unit Cu may have a capacitance varying according to time. Capacitor unit Cu may have a first capacitance during a first time period during which first switching transistor M2 is turned on. Capacitor unit Cu may have a second capacitance during a second time period in which first switching transistor M2 is turned off. The second capacitance may be smaller than the first capacitance.

Driving transistor M1 may generate a driving current corresponding to the voltage stored in capacitor unit Cu.

Organic light-emitting diodes (OLEDs) may emit light according to the driving current generated by driving transistor M1.

As shown in FIG. 1, the capacitor unit Cu may include second switching transistor M3, storage capacitor Cs, and common capacitor Cm. Storage capacitor Cs may have a first electrode connected to the gate of driving transistor M1 and a second electrode connected to the source of driving transistor M1. A control circuit comprising second switching transistor M3 and common capacitor Cm connected in series may be connected between the gate and source of driving transistor M1. When second switching transistor M3 is turned on, common capacitor Cm may be connected to storage capacitor Cs in parallel.

Second switching transistor M3 may transmit, to common capacitor Cm, the data signals transmitted by first switching transistor M2 in response to the scan signals transmitted through scan line SLa. Second switching transistor M3 which receives the scan signals having a gate-on voltage level (for example, a low level) may be turned on, and common capacitor Cm and storage capacitor Cs may be connected in parallel. As the data signals transmitted by first switching transistor M2 are applied to common capacitor Cm and storage capacitor Cs, a voltage corresponding to the data signals is stored in common capacitor Cm and storage capacitor Cs. As the scan signals is set to a gate-off voltage level (for example, a high level), the voltage corresponding to the data signals may be maintained between the gate and source of driving transistor M1 by storage capacitor Cs even when common capacitor Cm and storage capacitor Cs are disconnected from DLb.

To display a higher quality image, pixel resolution may be increased and pixel density may be increased. The size of the pixels PXs may be decreased to increase the pixel density. For each PX, the majority of the pixel area thereof may be occupied by a capacitor. The capacitor maintains a control voltage of driving transistor M1. When the size of the capacitor is decreased to decrease the size of pixel PX, an electric potential of a gate of driving transistor M1 may vary due to capacitive coupling between the scan line and the gate at a point in time when voltage level of the scan signals change. For example, when the capacitance of a capacitor of a pixel is cut in half, variation in the electric potential of the gate may double due to interference from the scan signal. When the capacitance of the capacitor of a pixel is doubled, the variation of the electric potential of the gate may be decreased by half due to the interference from the scan signal.

According to one or more exemplary embodiment, when the capacitance of capacitor unit Cu is temporarily increased at a point in time when the scan signals transmitted through the scan lines change, the variation of the electric potential of the gate of driving transistor M1 may be decreased due to the interference from the scan signals. Since the gate of driving transistor M1 is not affected by the capacitive coupling at a point in time when the scan signals transmitted through the scan lines do not change, the electric potential of the gate of driving transistor M1 may not change even though the capacitance of capacitor unit Cu is small. Since the capacitance of capacitor unit Cu may decrease at a point in time when the scan signals transmitted through the scan lines are not transited, that is, during a period of time when the scan signals continue to have the gate-off voltage level, the sizes of pixels PXs may be decreased by configuring pixels PXs such that common capacitor Cm of each PX is located outside pixels PXs or by designing the pixels PXs such that a common capacitor Cm is shared between a plurality of pixels PXs.

As shown in FIG. 1, pixel PXab according to an exemplary embodiment may include driving transistor M1, first and second switching transistors M2 and M3, storage capacitor Cs, and common capacitor Cm. First switching transistor M2 may include a control electrode connected to scan line SLa transmitting the scan signals, a first connection electrode connected to data line DLb transmitting the data signals, and a second connection electrode connected to the gate of driving transistor M1. First switching transistor M2 may be turned on during a time period in which the scan signals have a gate-on voltage level (for example, a low level), and the data signals received by the first connection electrode may be provided to the gate of driving transistor M1.

Second switching transistor M3 may include a control electrode connected to scan line SLa together with the control electrode of first switching transistor M2, a first connection electrode commonly connected to the gate of driving transistor M1 and the second connection electrode of first switching transistor M2, and a second connection electrode connected to the first electrode of common capacitor Cm. Second switching transistor M3 may operate in the same manner as first switching transistor M2 in response to the scan signals transmitted though scan line SLa. Second switching transistor M3 may be turned on during a time period when the scan signals have a gate-on voltage level (for example, a low level), the data signals received by the first connection electrode may be provided to the first electrode of common capacitor Cm. As a result, common capacitor Cm and storage capacitor Cs may be connected in parallel. Capacitor unit Cu may have a first capacitance which corresponds to a sum of a capacitance of common capacitor Cm and that of storage capacitor Cs. The first electrode of common capacitor Cm may float when switching transistor M3 is off during a time period when the scan signals have a gate-off voltage level (for example, a high level). In this case, capacitor unit Cu has a second capacitance which corresponds to the capacitance of storage capacitor Cs.

Driving transistor M1 may include a gate which is commonly connected to the second connection electrode of first switching transistor M2 and the first connection electrode of second switching transistor M3, a source which is commonly connected to the second electrode of storage capacitor Cs and the second electrode of common capacitor Cm, and a drain connected to an OLED. Since the voltage stored in storage capacitor Cs may be applied between the gate and the source, driving transistor M1 may generate a driving voltage based on the voltage stored in storage capacitor Cs.

Storage capacitor Cs may have the first electrode connected to the gate of driving transistor M1 and the second electrode connected to the source of driving transistor M1.

Common capacitor Cm may include the first electrode connected to the second connection electrode of second switching transistor M3 and the second electrode commonly connected to the second electrode of storage capacitor Cs and the source of driving transistor M1.

First driving power ELVDD of pixel PXab may be applied to the source of driving transistor M1, and the drain of driving transistor M1 may be connected to an anode of the OLED. Second driving power ELVSS may be applied to a cathode of the OLED.

Transistors M1, M2, and M2 shown in FIG. 1 are p-type transistors, but the inventive concept is not limited thereto. One or more of transistors M1, M2, and M2 may be n-type transistors.

FIG. 1 illustrates an exemplary embodiment of a circuit diagram of pixel PXab, but aspects of the inventive concept are not limited thereto. Pixel PXab may further include at least one additional transistor and/or at least one additional capacitor in order to initialize the anode of the OLED so that a threshold voltage of driving transistor M1 is compensated or hysteresis properties thereof may be initialized. For example, pixel PXab may further include a transistor connected between the gate and drain of driving transistor M1.

Figure 2:
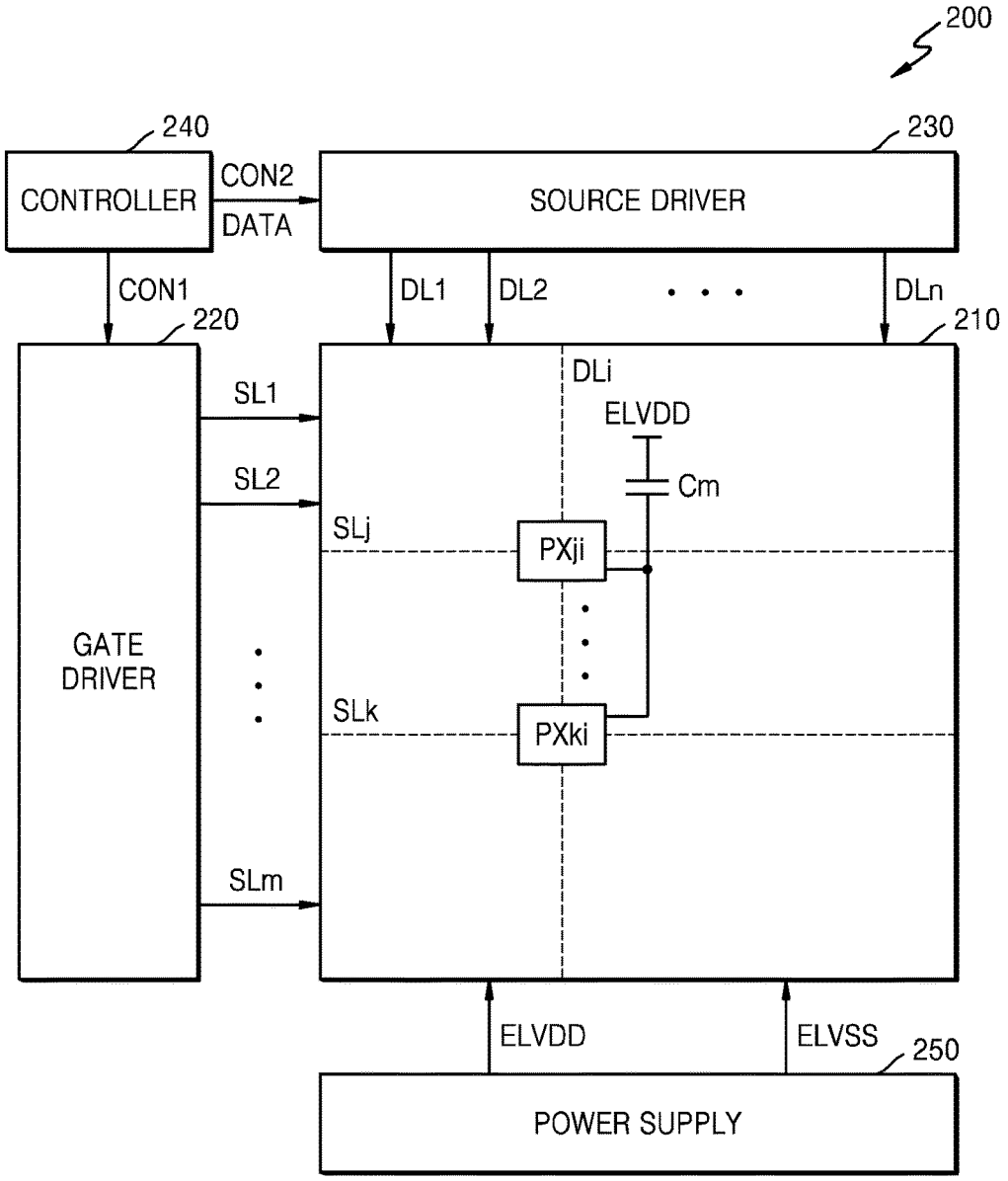
FIG. 2 is a schematic block diagram of an organic light-emitting display device according to one or more exemplary embodiments.

FIG. 2 is a schematic block diagram of an organic light-emitting display device 200 according to one or more exemplary embodiments.

Referring to FIG. 2, the organic light-emitting display device 200 may include display panel 210, gate driver 220, source driver 230, controller 240, and power supply 250. Gate driver 220, source driver 230, controller 240, and power supply 250 respectively correspond to gate driver 120, source driver 130, controller 140, and power supply 150 of FIG. 1, and thus, descriptions of gate driver 220, source driver 230, controller 240, and power supply 250 will not be repeated.

Display panel 210 includes scan lines SL1 to SLm, data lines DL1 to DLn, and pixels (hereinafter, collectively referred to as 'pixels PXs') connected to scan lines SL1 to SLm and data lines DL1 to DLn. Pixels PXs include first pixel PXji connected to scan line SLj and data line DLi and second pixel PXki connected to scan line SLk and data line DLi.

First pixel PXji and second pixel PXki may be arranged in the same column and may both be connected to data line DLi. First pixel PXji and second pixel PXki may be connected to the first electrode of common capacitor Cm. First pixel PXji and second pixel PXki may have the same circuit. Pixels PXs included in display panel 210 may have the same circuit as first pixel PXji and second pixel PXki as shown in FIG. 2.

By using common capacitor Cm, respective capacitances of first pixel PXji and second pixel PXki may increase during a period of time when first pixel PXji and second pixel PXki are respectively selected by the scan signals. Common capacitor Cm may be arranged on an outer periphery of a display unit in which pixels PXs are arranged.

Display panel 210 may include common capacitors Cm arranged in each column of display panel 210, and each common capacitor Cm may be connected to at least two pixels PXs arranged in the same column. Common capacitor Cm may be connected to some pixels PXs from among pixels PXs arranged in the same column. According to an exemplary embodiment, common capacitor Cm may be connected to all pixels PXs arranged in the same column.

Common capacitor Cm may be connected to pixels PXs arranged in the same column and shared by pixels PXs connected to common capacitor Cm. Since pixels PXs connected to common capacitor Cm are arranged in the same column, pixels PXs may not be simultaneously selected by scan lines SL. In other words, common capacitor Cm may not be shared by two or more pixels PXs receiving information from data lines DL unless Cm is somehow disconnected from one of them. Pixels PXs connected to common capacitor Cm will be referred to as common pixels PXs.

Common capacitor Cm has a first electrode and a second electrode. The first electrode may be selectively connected to a first electrode of a storage capacitor of common pixels PXs in response to the scan signals. The second electrode may be selectively connected to a second electrode of the storage capacitor of common pixels PXs. When each common pixel PX is selected by the scan signals, common capacitor Cm may be connected to the storage capacitor of common pixels PXs in parallel, and first driving power ELVDD may be applied to the second electrode of common capacitor Cm.

Common capacitor Cm and at least two common pixels PXs (for example, first pixel PXji and second pixel PX ki) connected thereto will be described in detail with reference to FIG. 3.

Figure 3:
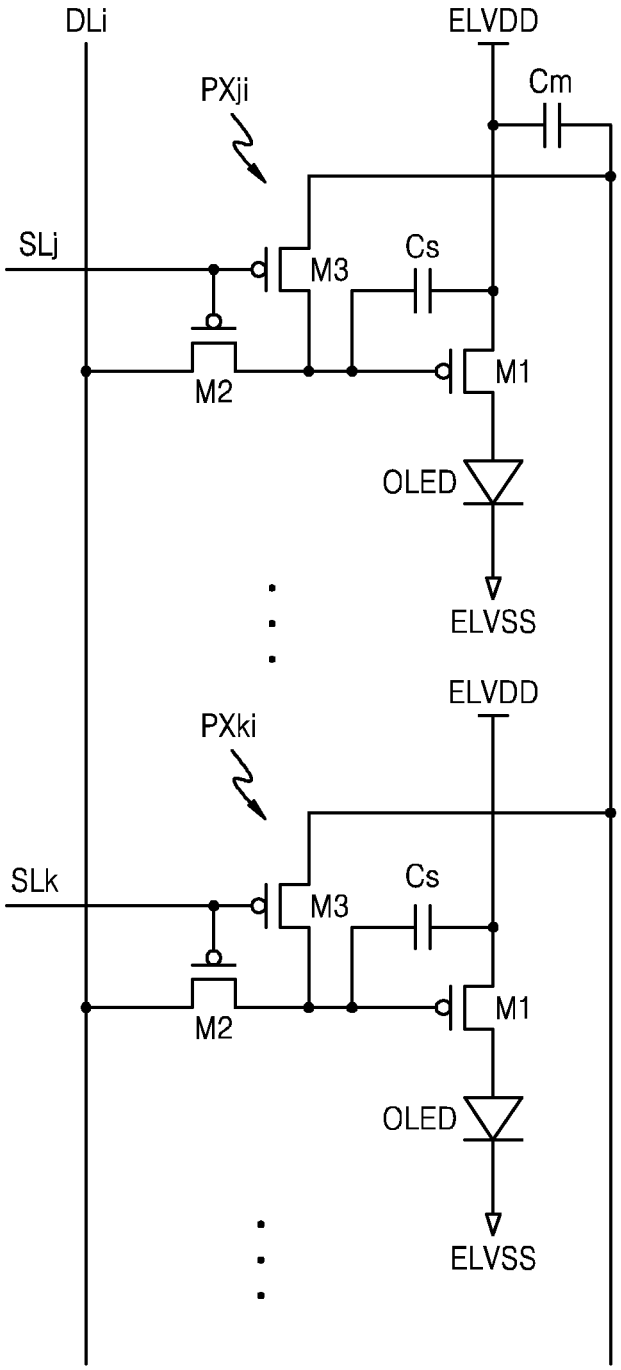
FIG. 3 is a circuit diagram of pixels according to one or more exemplary embodiments.

FIG. 3 is a circuit diagram of pixels according to one or more exemplary embodiments.

Referring to FIG. 3, first pixel PXji and second pixel PXki respectively include driving transistor M1, first switching transistor M2, second switching transistor M3, and storage capacitor Cs. As shown in FIG. 3, since a circuit of second pixel PXki may be substantially the same as a circuit of first pixel PXji, descriptions corresponding to second pixel PXki in relation driving transistor M1, first switching transistor M2, second switching transistor M3, and storage capacitor Cs will be replaced with descriptions of the same corresponding to first pixel PXji, and not repeated.

Hereinafter, first pixel PXji will be described. First switching transistor M2 is connected to scan line SLj and data line DLi. First switching transistor M2 may transmit the data signals, which are transmitted through data line DLi in response to the scan signals transmitted through scan line SLj, to storage capacitor Cs and driving transistor M1. Storage capacitor Cs may store a voltage corresponding to the data signals transmitted by first switching transistor M2. Storage capacitor Cs may be connected between the gate and the source of driving transistor M1. Driving transistor M1 may generate a driving current corresponding to the voltage stored in storage capacitor Cs. The OLED may emit light according to the driving current generated by driving transistor M1.

With common capacitor Cm, when the capacitance of storage capacitor Cs is small, since scan line SLj may be located near to the gate of driving transistor M1, a potential of the gate of driving transistor M1 may change due to transmission of the scan signals through scan line SLj. For example, when the scan signals change, the potential of the gate of driving transistor M1 may be increased due to an influence of the scan signals. When the scan signals change to a low level, the potential of the gate of driving transistor M1 may be decreased due to the influence of the scan signals. Since a variation of the potential of the gate of driving transistor M1 is low when the capacitance of storage capacitor Cs is high, the variation of the potential of the gate driving transistor M1 may be low, and the variation may not be detectable. If the capacitance of storage capacitor Cs is small, the variation of the potential of the gate of driving transistor M1 may be high, and the variation may be detectable. Thus, conventional organic light-emitting display devices used storage capacitors of a size to prevent detectable variation.

According to an exemplary embodiment, storage capacitor Cs may have a capacitance which is smaller than a capacitance of a storage capacitor of a conventional organic light-emitting display device. For example, the capacitance of storage capacitor Cs may be half the capacitance of storage capacitor Cs of the conventional organic light-emitting display device, and smaller as a result.

According to an exemplary embodiment, first pixel PXji may include second switching transistor M3 which operates in response to the scan signals transmitted through scan line SLj. The gate (for example, the control electrode) of second switching transistor M3 may be connected to scan line SLj together with the gate of first switching transistor M2. Second switching transistor M3 may be connected between first switching transistor M2 and common capacitor Cm. Second switching transistor M3 may transmit, to common capacitor Cm, the data signals transmitted by first switching transistor M2 in response to the scan signals transmitted through scan line SLj. Second switching transistor M3, which receives the scan signals having a gate-on voltage level (for example, a low level), may be turned on, and storage capacitor Cs and common capacitor Cm may be connected to each other in parallel. Capacitance between the gate and the source of driving transistor M1 included in first pixel PXji may be increased by the capacitance of common capacitor Cm. Accordingly, the variation of the potential of the gate of driving transistor M1, which occurs due to capacitive coupling with the scan signals, may be decreased.

Common capacitor Cm may be connected to first pixel PXji as well as second pixel PXki. Common capacitor Cm may be connected to pixels PXs connected to data line DLi. Common capacitor Cm may include a first electrode which is commonly connected to the second connection electrode of second switching transistor M3 included in each of first pixel PXji and second pixel PXki. Common capacitor Cm may include a second electrode which may be commonly connected to the second electrode of storage capacitor Cs included in each of first pixel PXji and second pixel PXki. FIG. 3 shows that the second electrode of common capacitor Cm is connected to the second electrode of storage capacitor Cs included in first pixel PXji. However, since the second electrode of storage capacitor Cs included in each of first pixel PXji and second pixel PXki may be connected to each other through a power line via which first driving power ELVDD is applied, the second electrodes of storage capacitors Cs may be connected to the second electrodes of the storage capacitor Cs included in first pixel PXji as well as second pixel PXki.

As shown in FIG. 3, first pixel PXji may include driving transistor M1, first switching transistor M2, second switching transistor M3, and storage capacitor Cs. First switching transistor M2 may include the control electrode connected to scan line SLj, the first connection electrode connected to data line DLi, and the second connection electrode connected the gate of driving transistor M1. Second switching transistor M3 may include the control electrode connected to scan line SLj, the first connection electrode commonly connected to the second connection electrode of first switching transistor M2 and the gate of driving transistor M1, and the second connection electrode connected to the first electrode of common capacitor Cm. Driving transistor M1 may include the gate commonly connected to the second connection electrode of first switching transistor M2 and the first connection electrode of second switching transistor M3, the source commonly connected to the second electrode of storage capacitor Cs and the second electrode of common capacitor Cm, and the drain connected to the OLED. Storage capacitor Cs may include the first electrode connected to the gate of driving transistor M1 and the second electrode connected to the source of driving transistor M1.

First driving power ELVDD of pixels PXs may be applied to the source of driving transistor M1, the drain of driving transistor M1 may be connected to an anode of the OLED, and second driving power ELVSS may be applied to a cathode of the OLED.

FIG. 3 shows transistors M1, M2, and M3 are p-type transistors, but aspects of the inventive concept are not limited thereto. One or more of transistors M1, M2, and M3 may be n-type transistors. FIG. 3 illustrates an exemplary embodiment of circuit diagrams of first and second pixels PXji and PXki, but aspects of the inventive concept are not limited thereto.

According to one or more of the exemplary embodiments, the size of capacitors included in pixels PXs may be decreased. Therefore, a pixel density may be increased, and a higher quality image may be displayed. While the pixel density is increased, interference between signals may be decreased by temporarily increasing a capacitance in pixels PXs at times when the interference between the signals might otherwise occur.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An organic light-emitting display device comprising:

a first pixel;

a second pixel;

a third pixel; and a common capacitor comprising a first electrode commonly connected to the first, second and third pixels and a second electrode connected to a power line having a driving voltage, and disposed in a same column as the first, second and third pixels, wherein the first pixel comprises:

a first switching transistor transmitting a first data signal in response to a first scan signal;

a second switching transistor transmitting the first data signal to the first electrode of the common capacitor in response to the first scan signal;

a first storage capacitor storing a charge corresponding to the first data signal;

a first driving transistor generating a first driving current corresponding to the charge stored in the first storage capacitor; and a first organic light-emitting diode (OLED) emitting light corresponding to the first driving current, and wherein the second pixel comprises:

a third switching transistor transmitting a second data signal in response to a second scan signal;

a fourth switching transistor transmitting the second data signal to the first electrode of the common capacitor in response to the second scan signal;

a second storage capacitor storing a charge corresponding to the second data signal;

a second driving transistor generating a second driving current corresponding to the charge stored in the second storage capacitor; and a second organic light-emitting diode (OLED) emitting light corresponding to the second driving current, and wherein the third pixel comprises:

a fifth switching transistor transmitting a third data signal in response to a third scan signal;

a sixth switching transistor transmitting the third data signal to the first electrode of the common capacitor in response to the third scan signal;

a third storage capacitor storing a charge corresponding to the third data signal;

a third driving transistor generating a third driving current corresponding to the charge stored in the third storage capacitor; and a third organic light-emitting diode (OLED) emitting light corresponding to the third driving current.

2. The organic light-emitting display of claim 1, wherein the common capacitor comprises:

the first electrode commonly connected to the second, fourth, and sixth switching transistors; and the second electrode commonly connected to the first, second, and third storage capacitors.

3. The organic light-emitting display of claim 1, wherein the first storage capacitor comprises a first electrode connected to a gate of the first driving transistor and a second electrode connected to a source of the first driving transistor, the first switching transistor comprises a control electrode to receive the first scan signal, a first connection electrode to receive the first data signal, and a second connection electrode connected to the gate of the first driving transistor, further wherein the gate of the first driving transistor is commonly connected to the second connection electrode of the first switching transistor and a first connection electrode of the second switching transistor; the source of the first driving transistor is commonly connected to the second electrode of the storage capacitor and the second electrode of the common capacitor; and a drain of the first driving transistor is connected to the OLED, and the second switching transistor comprising a control electrode receiving the first scan signal, the first connection electrode of the second switching transistor connected to the second connection electrode of the first switching transistor, and a second connection electrode connected to the first electrode of the common capacitor.

4. The organic light-emitting display of claim 1, wherein the common capacitor is connected in parallel with the first storage capacitor when the second switching transistor is turned on, the common capacitor is connected in parallel with the second storage capacitor when the fourth switching transistor is turned on, and the common capacitor is connected in parallel with the third storage capacitor when the sixth switching transistor is turned on.

5. The organic light-emitting display of claim 1, further comprising:

a data line extending in a column direction and configured to transmit the first, second and third data signals to the first, second and third pixels, respectively; and first, second and third scan lines extending in a row direction and configured to transmit the first, second and third scan signals to the first, second and third pixels, respectively.

6. The organic light-emitting display of claim 5, further comprising a column of pixels, including the first, second, and third pixels, wherein the pixels in the column of pixels are connected to the data line and the first electrode of the common capacitor.

7. An organic light-emitting display device, comprising:

common capacitors respectively disposed in respective columns of the organic light-emitting display device; and a plurality of pixels, each of the pixels comprising:

a first switching transistor transmitting a data signal in response to a scan signal;

a second switching transistor transmitting the data signal to a first electrode of a common capacitor disposed in a same column as the pixel circuit among the common capacitors in response to the scan signal;

a storage capacitor storing a charge corresponding to the data signal;

a driving transistor generating a driving current corresponding to the charge; and an organic light-emitting diode (OLED) emitting light corresponding to the driving current, wherein the first switching transistor comprises a control electrode receiving the scan signal, a first connection electrode receiving the data signal, and a second connection electrode directly connected to a gate of the driving transistor, and wherein the first electrode of the common capacitor is commonly connected directly to the second switching transistor of at least three pixels disposed in a same column as the common capacitor among the plurality of pixels.

8. The organic light-emitting display device of claim 7, wherein the common capacitor is connected in parallel with the storage capacitor when the second switching transistor is turned on.

9. The organic light-emitting display device of claim 7, wherein each of the common capacitors has a second electrode connected to the storage capacitor.

10. The organic light-emitting display device of claim 7, wherein the storage capacitor comprises a first electrode connected to the gate of the driving transistor and a second electrode connected to a source of the driving transistor, the second switching transistor comprises a control electrode receiving the scan signal, a first connection electrode connected to the second connection electrode of the first switching transistor, and a second connection electrode connected to the first electrode of the common capacitor, and wherein the driving transistor comprises the gate commonly connected to the second connection electrode of the first switching transistor and a first connection electrode of the second switching transistor, the source commonly connected to the second electrode of the storage capacitor and the second electrode of the common capacitor, and a drain connected to the OLED.

11. The organic light-emitting display device of claim 7, wherein the driving transistor comprises a source to which a driving power is applied and a drain connected to an anode of the OLED.

* * * * *